US011460806B2

(12) United States Patent
Sakurai

(10) Patent No.: US 11,460,806 B2
(45) Date of Patent: Oct. 4, 2022

(54) FIXING DEVICE AND IMAGE FORMING APPARATUS

(71) Applicant: CANON KABUSHIKI KAISHA, Tokyo (JP)

(72) Inventor: Takanori Sakurai, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/475,119

(22) Filed: Sep. 14, 2021

(65) Prior Publication Data

US 2022/0091557 A1 Mar. 24, 2022

(30) Foreign Application Priority Data

Sep. 24, 2020 (JP) ..... JP2020-159775

(51) Int. Cl.
*G03G 15/20* (2006.01)
*G03G 21/20* (2006.01)

(52) U.S. Cl.
CPC ..... *G03G 21/206* (2013.01); *G03G 15/2028* (2013.01)

(58) Field of Classification Search
CPC ..... G03G 21/206; G03G 15/2028; G03G 15/2021
See application file for complete search history.

(56) References Cited

U.S. PATENT DOCUMENTS 9,411,275 B2 8/2016 Sugiyama et al. ..... G03G 15/2028
11,042,113 B2 * 6/2021 Akamatsu ..... G03G 15/6573
2012/0201564 A1 * 8/2012 Masuda ..... G03G 15/6558 399/92
2015/0338796 A1 * 11/2015 Koga ..... G03G 15/2025 399/341
2016/0116885 A1 * 4/2016 Pearce ..... G03G 15/657 399/92
2016/0313694 A1 * 10/2016 Wakimoto ..... G03G 15/2017
2017/0038709 A1 2/2017 Masuda ..... G03G 15/2028
2018/0290474 A1 * 10/2018 Dunn ..... B41J 29/377
2019/0196369 A1 * 6/2019 Sakamoto ..... G03G 21/206
2019/0196397 A1 * 6/2019 Sakamoto ..... G03G 21/206
2022/0057747 A1 * 2/2022 Omura ..... G03G 21/206

FOREIGN PATENT DOCUMENTS

JP 2011-090170 5/2011

* cited by examiner

*Primary Examiner* — Sevan A Aydin
(74) *Attorney, Agent, or Firm* — Venable LLP

(57) ABSTRACT

A fixing device includes a first feeder provided downstream of a fixing portion heating a toner image formed on a first side of a sheet in a feeding direction, a second feeder provided adjacent downstream of the first feeder, and a guide contacting with a second side of the sheet fed by the first feeder and guiding toward the second feeder, a blower, a first duct guiding the air at a first position between the first and feeders, and a second duct at a second position between the first position and the first feeder. The first and second feeders are contactable to the sheet over an entire width. The air from the blower passes through the first duct, is sent to a feeding passage formed between the first and second feeders from the first position, and sent to the second side, then, the air passes through the second duct from the feeding passage via the second position and is exhausted.

9 Claims, 6 Drawing Sheets

FIXING DEVICE AND IMAGE FORMING APPARATUS

FIELD OF THE INVENTION AND RELATED ART

The present invention relates to a fixing device for fixing a toner image on a sheet and an image forming apparatus equipped with the same.

In general, an image forming apparatus is known to be equipped with a fixing device that transfers a toner image onto a sheet and fixes the toner image onto the sheet by applying heat and pressure to the transferred toner image. The image forming apparatus is equipped with a first feeding roller pair downstream of the fixing device to eject the sheet on which the toner image has been fixed.

In the fixing device, the sheet before it is fixed contains some moisture, and when it is heated during the fixing of the toner image, water vapor is released from the sheet. When this water vapor stays between the fixing device and the first feeding roller pair and condenses on the surface of the feeding guide, the sheet being fed absorbs the condensed water and may cause a jam or image defects.

In the image forming apparatus described in Japanese Laid Open Patent Application No. 2011-90170, the first feeding roller pair comprises a roller pair forming two nip portions in the sheet widthwise direction perpendicular to the sheet feeding direction. In other words, in the sheet widthwise direction, the sheet has a region that contacts these two roller pairs and a region that does not contact the two roller pairs. Specifically, in the widthwise direction of the sheet, the center of the sheet does not contact the two roller pairs of the first feeding roller pair. With this configuration, the air containing water vapor generated when the sheet is fixed by the fixing device is exhausted through the first feeding roller pair and the sheet feeding passage.

However, in the image forming apparatus described in Japanese Laid-Open Patent Application No. 2011-90170, when the sheet that has passed through the fixing device is nipped by the first feeding roller pair, unevenness in the gloss of the fixed image may occur. This is because the first feeding roller pair has two areas in the sheet widthwise direction, one that contacts the sheet and one that does not, so the sheet is quenched by the contact. In recent years, there has been a need to reduce image defects and uneven gloss caused by condensation, and to provide high quality results.

SUMMARY OF THE INVENTION

The objective of the present invention is to provide a fixing device and an image forming apparatus equipped with the same, which can provide high quality results.

One embodiment of the present invention is a fixing device comprising: a fixing portion configured to heat a toner image formed on a first side of a sheet and to fix the toner image on the sheet; a first rotatable member pair provided on a downstream side of said fixing device with respect to a sheet feeding direction and configured to feed the sheet; a second rotatable member pair provided adjacent to the downstream of said first rotatable member pair with respect to the sheet feeding direction and configured to feed the sheet; a guide portion configured to contact with a second side of the sheet opposite to the first side of the sheet fed by said first rotatable member pair and guide toward said second rotatable member pair, said guide portion forming a part of a feeding passage between said first rotatable member pair and said second rotatable member pair with respect to the sheet feeding direction; a blowing portion configured to blow air toward said feeding passage; a first duct configured to guide the air from said blowing portion and communicate with said feeding passage at a first position on the downstream side of said first rotatable member pair and on an upstream side of said second rotatable member pair with respect to the sheet feeding direction; and a second duct configured to guide the air from said blowing portion and communicate with said feeding passage at a second position on the upstream side of the first position and on the downstream side of said first rotatable member pair with respect to the sheet feeding direction; wherein said first rotatable member pair and said second rotatable member pair are contactable to the sheet over an entire width of the sheet passing through said feeding passage with respect to a widthwise direction of the sheet perpendicular to the sheet feeding direction; and wherein the air from said blowing portion passes through said first duct, is sent to said feeding passage from the first position, is sent to the second side of the sheet passing through the feeding passage, and then, the air from said blowing portion passes through said second duct from said feeding passage via the second position and is exhausted.

Another embodiment of the present invention is fixing device comprising: a fixing portion provided with a fixing rotatable member pair configured to heat a toner image formed on a first side of a sheet and to fix the toner image on the sheet; a feeding rotatable member pair provided adjacent to a downstream of said fixing rotatable member pair with respect to a sheet feeding direction and configured to feed the sheet; a guide portion configured to contact with a second side of the sheet opposite to the first side of the sheet fed by said fixing rotatable member pair and guide toward said feeding rotatable member pair, said guide portion forming a part of a feeding passage between said fixing rotatable member pair and said feeding rotatable member pair with respect to the sheet feeding direction; a blowing portion configured to blow air toward said feeding passage; a first duct configured to guide the air from said blowing portion and communicate with said feeding passage at a first position on the downstream side of said fixing rotatable member pair and on an upstream side of said feeding rotatable member pair with respect to the sheet feeding direction; and a second duct configured to guide the air from said blowing portion and communicate with said feeding passage at a second position on the upstream side of the first position and on the downstream side of said fixing rotatable member pair with respect to the sheet feeding direction; wherein said fixing rotatable member pair and said feeding rotatable member pair are contactable to the sheet over an entire width of the sheet passing through said feeding passage with respect to a widthwise direction of the sheet perpendicular to the sheet feeding direction; and wherein the air from said blowing portion passes through said first duct, is sent to said feeding passage from the first position, is sent to the second side of the sheet passing through the feeding passage, and then, the air from said blowing portion passes through said second duct from said feeding passage via the second position and is exhausted.

Further features of the present invention will become apparent from the following description of exemplary embodiments (with reference to the attached drawings).

DESCRIPTION OF THE EMBODIMENTS

Embodiments for Implementing the Invention

First Embodiment

[Overall Structure]

Figure 1:
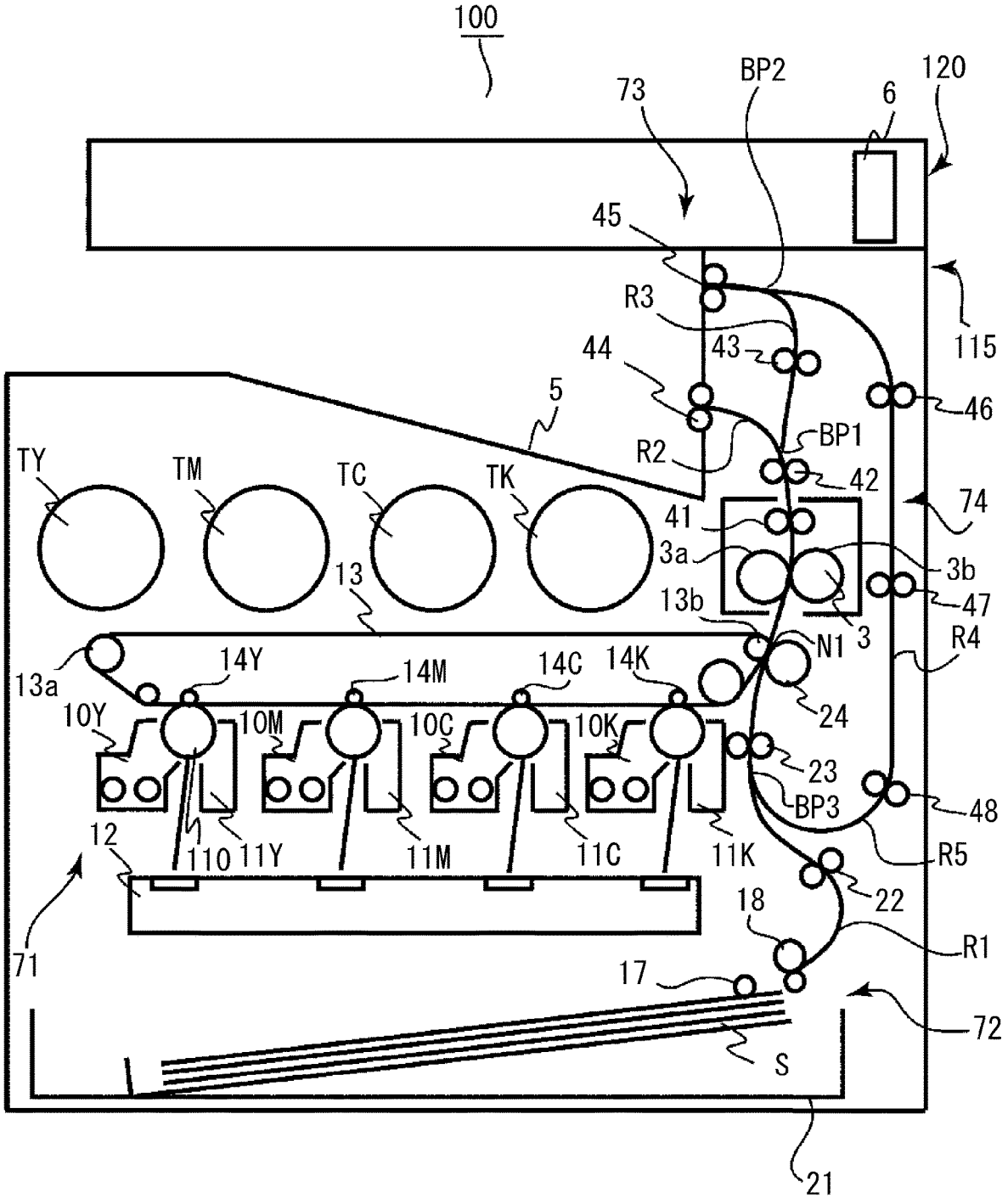
FIG. 1 is an overall schematic view showing the printer for the first embodiment.

A first embodiment of the present invention will be described. The printer 100 as an image forming apparatus is a full-color laser beam printer of the electrophotographic method. As shown in FIG. 1, the printer 100 has a printer main assembly 115 and a reading device 120 that is installed on the top of the printer main assembly 115.

The printer main assembly 115 has an image forming unit 71 that forms images on sheets S, a feeding portion 72, a fixing unit 3, a discharge reversal portion 73, and a double-side feeding portion 74. The imaging forming unit 71 as an image forming portion has four drum units 11Y, 11M, 11C, and 11K, four developing units 10Y, 10M, 10C, and 10K, toner storage units TY, TM, TC, and TK, and a scanner unit 12. Each drum unit and each developing unit is detachable from the printer main assembly 115. The four drum units 11Y, 11M, 11C, 11K and the four developing units 10Y, 10M, 10C, 10K have the same configuration except that the colors of the images to be formed are different. Therefore, only the configuration and image forming process of the drum unit 11Y and the developing unit 10Y will be described, and the description of other drum units and developing units will be omitted.

The drum unit 11Y has a photosensitive drum 110, an electrostatic portion (not shown), and a cleaning portion (not shown). The photosensitive drum 110 is composed of an aluminum cylinder with an organic photoconductive layer applied to its periphery, and is rotated by a drive motor (not shown). The cleaning portion cleans the toner that has not been fully transferred from the photosensitive drum 110.

The image forming unit 71 is provided with an intermediary transfer belt 13 wound around a drive roller 13*a* and a secondary transfer opposing roller 13*b*, etc., and primary transfer rollers 14Y, 14M, 14C, 14K are provided inside the intermediary transfer belt 13. In addition, a secondary transfer roller 24 is provided across the intermediary transfer belt 13, facing the secondary transfer opposing roller 13*b*, and the intermediary transfer belt 13 and the secondary transfer roller 24 form a transfer nip N1 as an image forming portion that transfers an image to the sheet S being fed.

The feeding portion 72 is provided in the lower part of the printer main assembly 115 and has a cassette 21 that supports sheets S and a pickup roller 17 that feeds the sheets S supported by the cassette 21. The feeding portion 72 has a separating roller pair 18 that separates the sheets S fed by the pickup roller 17 into individual sheets. The fixing unit 3 has a fixing roller 3*a* and a pressure roller 3*b* formed in a hollow shape, and a heater 26 (see FIG. 3) and a temperature sensor for measuring the temperature of the heater are built into the inside of the fixing roller 3*a*.

This section describes each feeding passage and the components for feeding sheets in the printer main assembly 115. The printer main assembly 115 consists of a supplying feeding passage R1, a discharge feeding passage R2 and a reversing feeding passage R3 that branch off at the branch point BP1, which is the downstream end of the supplying feeding passage R1 in the sheet feeding direction. The double-sided feeding passage R4 joins the reversing feeding passage R3 at the confluence point BP2. The double-sided feeding passage R4 guides the sheet with the image formed on the first side by the transfer nip N1 toward the transfer nip N1 again and joins the supplying feeding passage R1 at the confluence point BP3.

The discharge feeding passage R2 is provided with a discharge roller pair 44 that ejects the sheet S to a discharging tray 5, and the double-sided feeding passage R4 is provided with a reversing roller pair 45 that is configured for forward and reverse rotation and can switch back and feed the sheet S. In the reversing feeding passage R3, a feeding roller pair 43 is provided, and in the double-sided feeding passage R4, feeding roller pairs 46, 47, 48 are provided. A registration roller pair 23 (hereinafter referred to as the registration roller pair) is provided in the vicinity of the confluence point BP3 of the supplying feeding passage R1.

Next, the image forming operation of the printer 100 configured in this way will be described. When the image data read by the PC (not shown) or reading device 120 is input to the scanner unit 12, the scanner unit 12 irradiates the laser beam corresponding to the image data onto the photosensitive drum 110 of the drum unit 11Y. The image data read by the reading device 120 is sent to the control device 6 for storage.

At this time, the surface of the photosensitive drum 110 is uniformly charged to a predetermined polarity and potential in advance by the charging roller, and an electrostatic latent image is formed on the surface when the laser beam is irradiated from the scanner unit 12. The electrostatic latent image formed on the photosensitive drum 110 is developed by the developing unit 10Y supplied with toner from the toner storage portion TY, and a yellow (Y) toner image is formed on the photosensitive drum 110.

In the same way, each photosensitive drum of drum units 11M, 11C, and 11K is irradiated with a laser beam from scanner unit 12, and then magenta (M), cyan (C), and black (K) toner images are formed by developing units 10M, 10C, and 10K. The toner images of each color formed on each photosensitive drum are transferred to the intermediary transfer belt 13 by the primary transfer rollers 14Y, 14M, 14C, 14K, and conveyed to the transfer nip N1 by the intermediary transfer belt 13 rotated by the drive roller 13*a*. The image forming process of each color is performed at a timing to superimpose the image on the upstream toner image that has been primary transferred on the intermediary transfer belt 13. The toner remaining on the photosensitive drum 110 after the toner image is transferred is collected by the cleaning blade.

In parallel with this image forming process, the sheets S stored in the cassette 21 of the feeding portion 72 are fed out by the pickup roller 17 and separated into individual sheets by the separating roller pair 18. Then, the sheets S are adjusted for skew by the registration roller pair 23 and fed at a predetermined feeding timing in accordance with the transfer timing of the image at the transfer tip N1.

Then, the full-color toner image on the intermediary transfer belt 13 is transferred to the sheet S at the transfer nip N1 by the secondary transfer bias applied to the secondary transfer roller 24. The sheet S on which the toner image has been transferred is subjected to predetermined heat and pressure by the fixing roller 3*a* and pressure roller 3*b* of the fixing unit 3, and the toner is melted and fixed. The sheet S that has passed through the fixing unit 3 is fed into the discharge feeding passage R2 by the feeding roller pair 42 and is ejected into the discharging tray 5 by the discharging roller pair 44.

When a double-sided printing job in which images are formed on both sides of a sheet is input, the sheet S, which has been formed on the first side and passed through the fixing unit 3, is guided by a guiding member (not shown) to the reversing feeding passage R3. When the sheet is fed by the feeding roller pair 43 to the reversing roller pair 45, the reversing roller pair 45 first feeds the sheet S in the direction to eject it from the apparatus. When the rear end of the sheet S passes through the confluence point BP2, the reversing roller pair 45 reverses, and the sheet S reversed by the reversing roller pair 45 is fed through the double-sided feeding passage R4.

The sheet S is fed by the feeding roller pair 46, 47, 48 and merges into the supplying feeding passage R1 at the merging point BP3. After the skew is adjusted by the registration roller pair 23, an image is formed on the second side in the same manner as the first side, and the sheet S that has merged into the supplying feeding passage R1 is discharged into the discharging tray 5.

[Movement of Moisture Inside the Sheet]

Next, the movement of moisture inside the sheet is explained. FIG. 2A is a schematic view of the unfixed toner image S11 and the sheet S before it reaches the fixing unit 3. As shown in FIG. 2A, the sheet S has an image surface SA on which the toner image S11 has been transferred, and a non-image surface SB on the opposite side of the image surface SA. Inside the sheet S before reaching the fixing unit 3, moisture S12 is evenly distributed on both the image surface SA side and the non-image surface SB side.

Figure 2B:
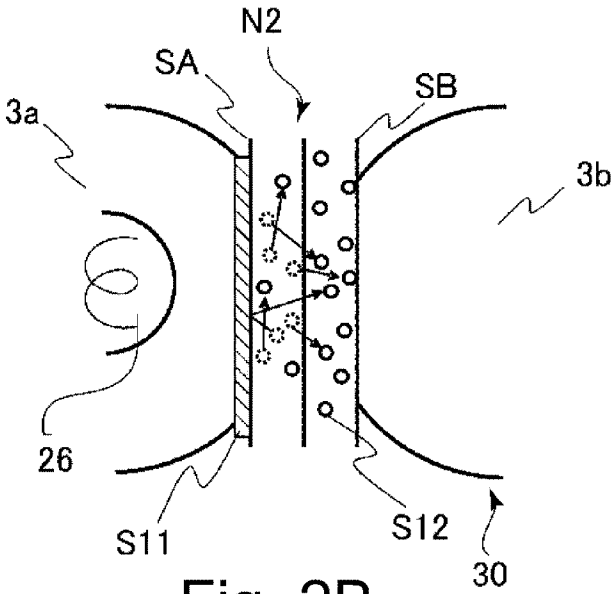
FIG. 2B is a schematic view showing the moisture state of a sheet passing through the fixing unit and the sheet as it passes through the fixing unit.

FIG. 2B is a schematic view of the sheet S as it passes through the fixing unit 3. As shown in FIG. 2B, the image surface SA is facing the fixing roller 3*a*, which has a built-in heater 26, and the non-image surface SB is facing the pressure roller 3*b*. The fixing roller 3*a* and the pressure roller 3*b* comprise a fixing roller pair as a fixing rotatable member pair.

The sheet S is heated and pressurized in the fixing nip N2 as the first nip formed by the fixing roller 3*a* and the pressure roller 3*b*, and the toner image S11 is fixed. At this time, the moisture S12 inside the sheet S moves from the image surface SA side to the non-image surface SB side due to the heat applied by the fixing roller 3*a*. The moisture S12 that has moved to the non-image side SB is prevented from being released from the sheet S by the pressure roller 3*b*, so it stays on the non-image side SB of the sheet S. In other words, the moisture S12 is distributed unevenly on the non-image surface SB side of the sheet S.

Figure 2D:
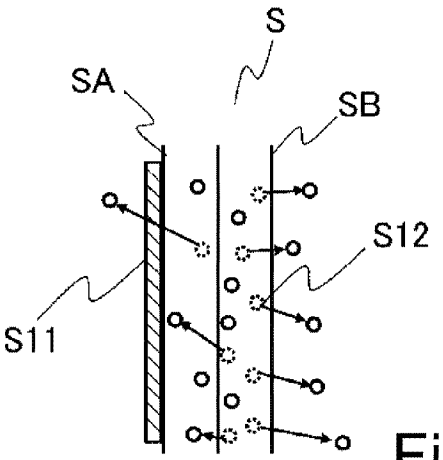
FIG. 2D is a schematic view of the moisture state of a sheet passing through the fixing unit, showing the sheet in a state of moisture release.
Figure 2A:
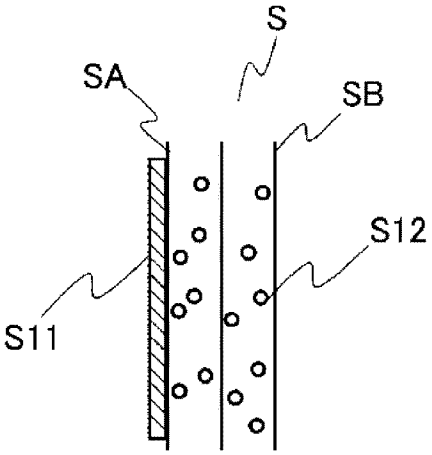
FIG. 2A is a schematic view showing the moisture state of a sheet passing through the fixing unit, and the unfixed toner image and sheet before the sheet reaches the fixing unit.
Figure 2C:
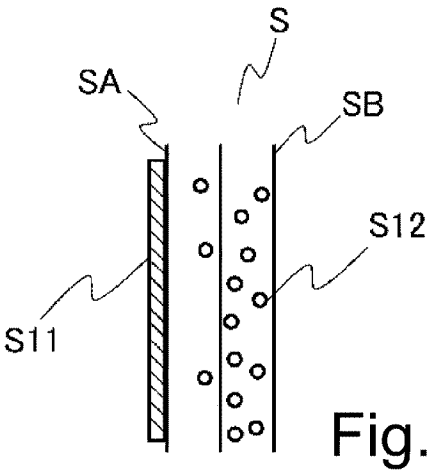
FIG. 2C is a schematic view showing the moisture state of the sheet as it passes through the fixing unit, and the state of the sheet immediately after it passes through the fixing unit.

FIG. 2C is a schematic view showing the state of the sheet S immediately after passing through the fixing unit 3. The sheet S contains more moisture S12 on the non-image side SB than on the image side SA. Then, as shown in FIG. 2D, the sheet S passes through the fixing nip N2 (see FIG. 2B), and the moisture S12 inside is released into the air. At this time, due to the unevenness of the moisture inside the sheet S, more moisture S12 is released into the air on the non-image side SB than on the image side SA.

[Structure of the Fixing Unit and the Discharge Reversal Portion]

Figure 3:
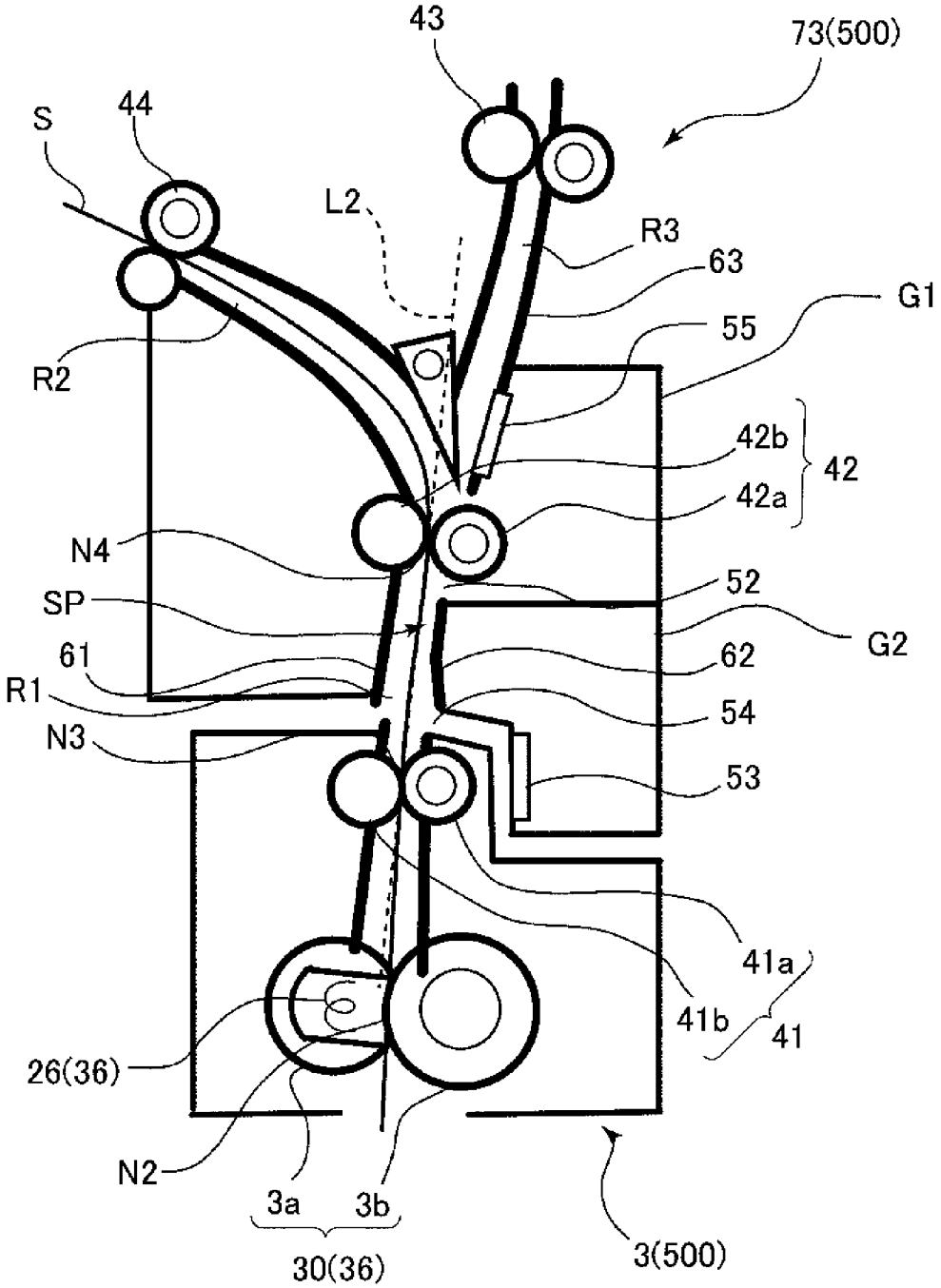
FIG. 3 is a cross-sectional view of the fixing unit and discharge reversal portion for the first embodiment.

Next, the structure of the fixing unit 3 and discharge reversal portion 73 is explained in detail. As shown in FIG. 3, the fixing unit 3 and discharge reversal portion 73 constitute the fixing device 500. The fixing unit 3 has a fixing roller pair 30 and a heater 26 built into the fixing roller 3*a* of the fixing roller pair 30. Also, the fixing unit 3 has a post-fixing roller pair 41 that is positioned downstream of the fixing unit 3 in the sheet feeding direction CD and feeds the sheet in the sheet feeding direction CD at nip N3 as the first nip. The fixing roller pair 30 and the heater 26 constitute the fixing device 36.

The post-fixing roller pair 41 has a drive roller 41*a* and a driven roller 41*b* that rotates under the drive roller 41*a*. The drive roller 41*a* and the driven roller 41*b* extend uniformly in the widthwise direction perpendicular to the sheet feeding direction CD (see FIG. 5). In other words, the post-fixing roller pair 41 as the first rotatable member pair is configured to contact the sheet S in the widthwise direction W over the entire width of the sheet S passing through the supplying feeding passage R1 as the feeding passage.

The discharge reversal portion 73 has a feeding roller pair 42, 43, a discharge roller pair 44, a reversing roller pair 45 (see FIG. 1), an air blowing duct G1, and an exhaust duct G2. The feeding roller pair 42 as the second rotatable member pair and the feeding rotatable member pair is positioned downstream of the post-fixing roller pair 41 to be adjacent to the post-fixing roller pair 41 in the sheet feeding direction CD. At nip N4 as the second nip, sheet S is fed to sheet feeding direction CD by the feeding roller pair 42. In sheet feeding direction CD, no other rollers are installed between the post-fixing roller pair 41 and the feeding roller pair 42.

Figure 5:
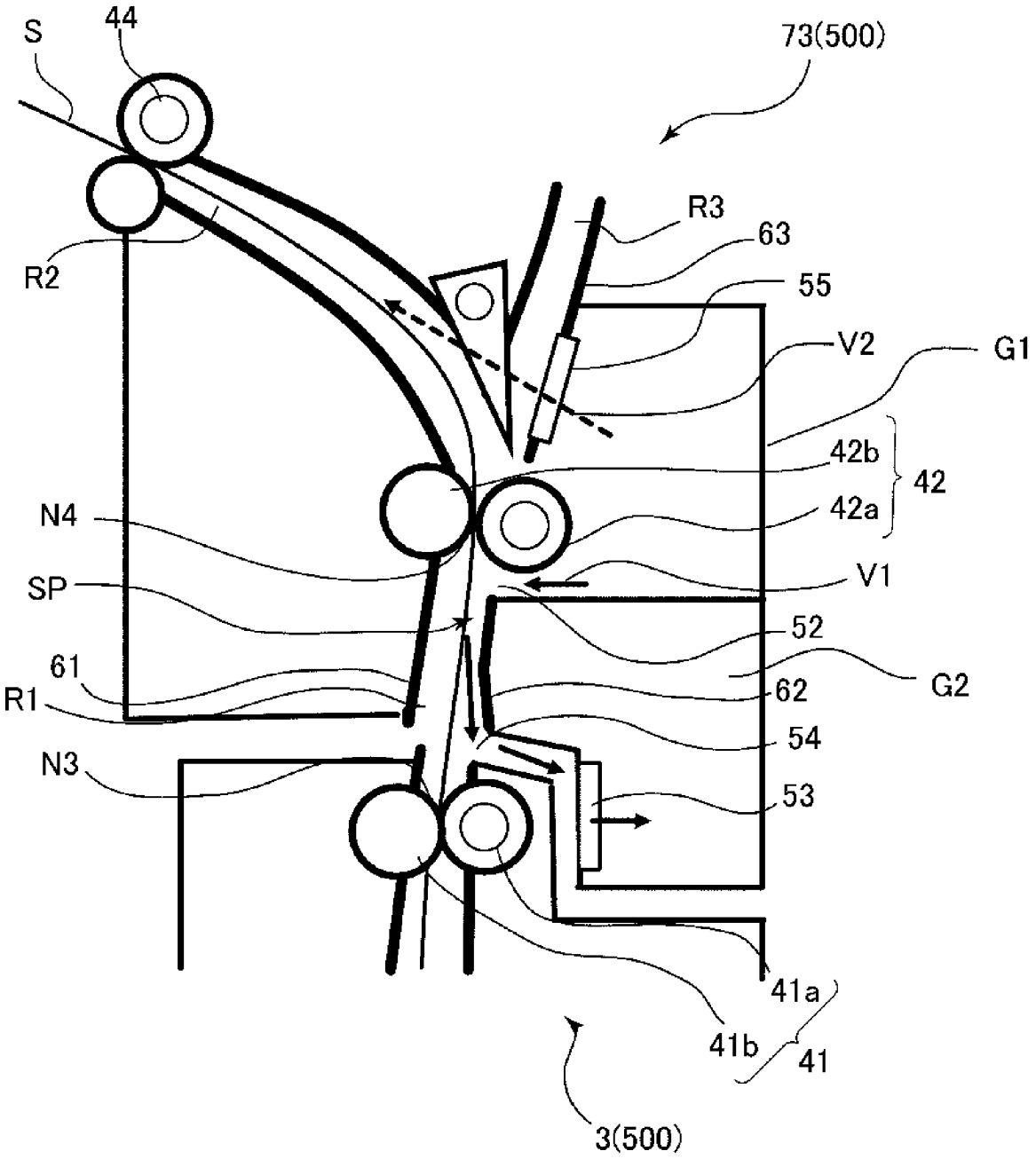
FIG. 5 is a cross-sectional view showing the air flow in the fixing unit and discharge reversal portion for the first embodiment.

The feeding roller pair 42 has a drive roller 42*a* and a driven roller 42*b* that rotates subject to the drive roller 42*a*, and the drive roller 42*a* and the driven roller 42*b* extend uniformly in the widthwise direction (see FIG. 5). In other words, the feeding roller pair 42 is configured to be able to contact the sheet S over the entire width of the sheet S passing through the supplying feeding passage R1 in the widthwise direction W.

Between the post-fixing roller pair 41 and the feeding roller pair 42 in the sheet feeding direction CD, the supplying feeding passage R1 is defined by a first guide 61 provided in the air blowing duct G1 and a second guide 62 provided in the exhaust duct G2 and opposing the first guide 61. That is, the second guide 62 as a guide portion defines a portion of the supplying feeding passage R1 between the post-fixing roller pair 41 and the feeding roller pair 42 in the sheet feeding direction CD. The air blowing duct G1 and the exhaust duct G2 are positioned on the same side as the second guide 62 with respect to the supplying feeding passage R1. The second guide 62, the air blowing duct G1 and the exhaust duct G2 are positioned on the opposite side of the heater 26 with respect to the straight line L2 passing through nip N3 and N4.

Figure 4:
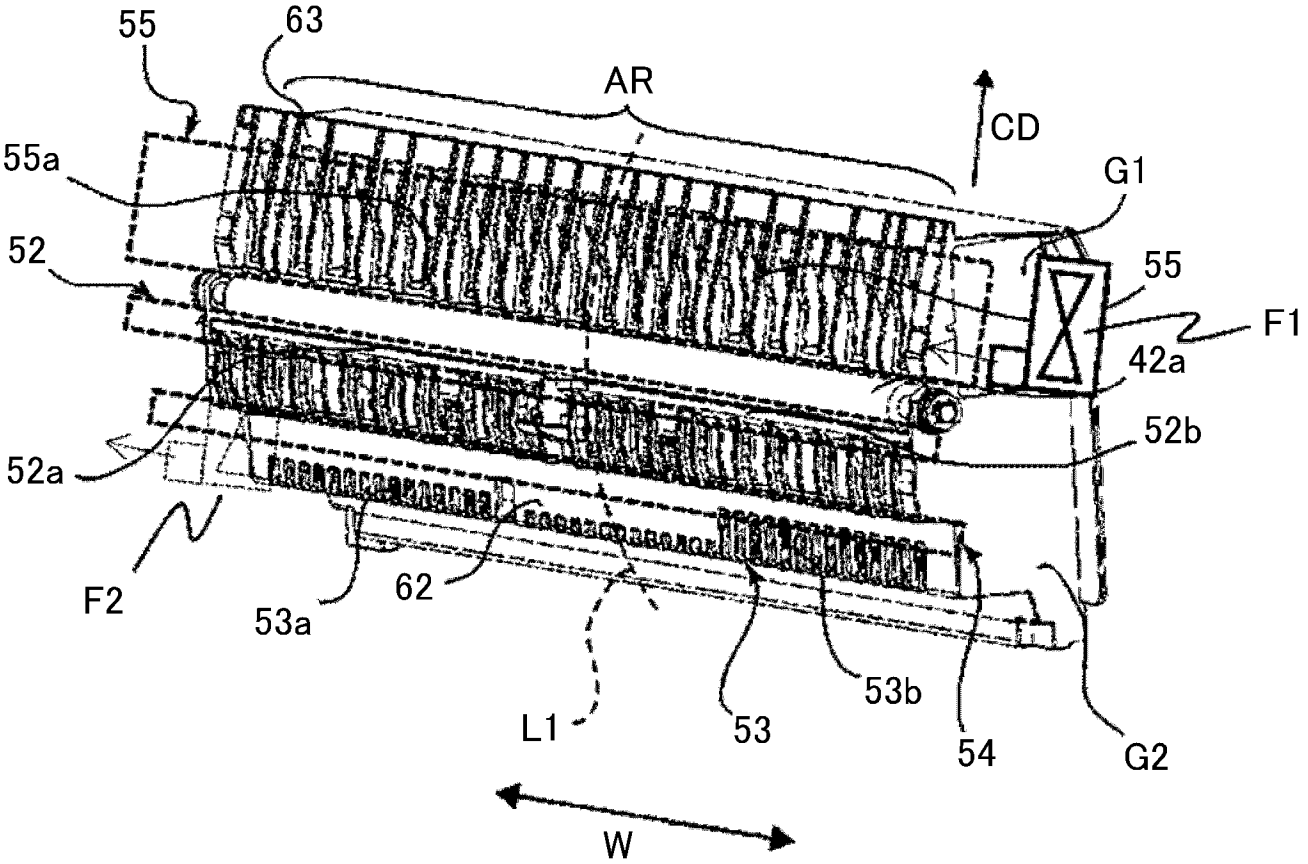
FIG. 4 is a perspective view showing the feeding passage after the fixing unit, air duct and exhaust duct for the first embodiment.

The exhaust duct G2 as the first duct has a connecting portion 54 that connects to the supplying feeding passage R1 at the first position downstream of the post-fixing roller pair 41 and upstream of the feeding roller pair 42 in the sheet feeding direction CD, as shown in FIGS. 3 and 4. The exhaust duct G2 has a plurality of opening portions 53 that are connected to the connecting portion 54. The plurality of opening portions 53 are arranged in the widthwise direction W over the entire width in the widthwise direction W of the sheet passing area AR through which the sheet S can pass in the supplying feeding passage R1. In more detail, the plurality of opening portions 53 have a first opening portion 53*a* positioned on one side of the central line L1 of the supplying feeding passage R1 in the widthwise direction W, and a second opening portion 53*b* positioned on the other side of the central line L1.

The blowing duct G1 as the second duct has a plurality of opening portions 52 connecting to the supplying feeding passage R1 at a second position downstream from the first position in the sheet feeding direction CD and upstream of the feeding roller pair 42. The plurality of opening portions 52 are arranged in the widthwise direction W over the entire width in the widthwise direction W of the sheet passing area AR. In more detail, the plurality of opening portions 52 has a third opening portion 52*a* positioned on one side of the central line L1 of the supplying feeding passage R1 in the widthwise direction W, and a fourth opening portion 52*b* positioned on the other side of the central line L1.

Furthermore, the blowing duct G1 has a plurality of opening portions 55 connected to the reversing feeding passage R3 at a third position downstream of the feeding roller pair 42 (drive roller 42*a*) and upstream of the feeding roller pair 43 in the sheet feeding direction CD. The plurality of opening portions 55 are arranged in the widthwise direction W over the entire width in the widthwise direction W of the sheet passing area AR. In more detail, the plurality of opening portions 55 have a fifth opening portion 55*a* disposed on one side of the central line L1 of the supplying feeding passage R1 (reversing feeding passage R3) in the widthwise direction W, and a sixth opening portion 55*b* disposed on the other side of the central line L1. The central line of the reversing feeding passage R3 coincides with the central line L1 of the supplying feeding passage R1.

The plurality of opening portions 53 are holes formed in the second guide 62 in the vicinity of the driving roller 41*a* of the post-fixing roller pair 41. Multiple ribs are formed in the second guide 62 to reduce the sliding resistance with the sheet S. The plurality of opening portions 52 is a gap between the feeding roller pair 42 and the second guide 62. The plurality of opening portions 55 are holes formed in the guiding member 63 defining a portion of the reversing feeding passage R3 in the vicinity of the drive roller 42*a* of the feeding roller pair 42. A plurality of ribs are formed in the guiding member 63 to reduce the sliding resistance with the sheet S.

[Air Flow in the Fixing Unit and Discharge Reversal Portion]

Next, using FIG. 5, the air flow through the fixing unit 3 and discharge reversal portion 73 will be explained. When the sheet S is nipped by the nip N3 of the post-fixing roller pair 41 and the nip N4 of the feeding roller pair 42, a space SP is surrounded by the post-fixing roller pair 41, the feeding roller pair 42, the second guide 62, and the sheet S in the widthwise direction W (see FIG. 4). In this embodiment, the post-fixing roller pair 41 and the feeding roller pair 42 extend uniformly in the widthwise direction W and are configured to contact the sheet S over the entire width of the sheet S. This is to prevent uneven cooling of the sheet S and the occurrence of uneven gloss.

The space SP faces the non-image surface SB of the sheet S (see part (d) of FIG. 2), and as illustrated in parts (a) through (d) of FIG. 2, more moisture is released from the non-image surface SB of the sheet S than from the image surface SA. This leads to condensation occurring easily, for example, on the second guide 62 surrounding the space SP. However, condensation can be suppressed by ventilating the space SP sufficiently.

Therefore, in the present embodiment, a blowing duct G1 and an exhaust duct G2 are installed to connect to the space SP. Specifically, the blowing duct G1 is connected to the supplying feeding passage R1 by a plurality of opening portions 52, and the exhaust duct G2 is connected to the supplying feeding passage R1 by a connecting portion 54 and a plurality of opening portions 53.

The blowing duct G1 is configured so that air V1 is blown from the inside of the duct to the supplying feeding passage R1 (space SP) through the plurality of opening portions 52 by the blowing fan F1, which is the first blowing portion. In other words, the blowing duct G1 is configured so that the air V1 blown toward the supplying feeding passage R1 passes through it. The air V1 flows through the supplying feeding passage R1 (space SP) from the downstream side of the sheet feeding direction CD to the upstream side, and the air inside the space SP is forced through the connecting portion 54 to the plurality of opening portions 53. The air that has passed through the multiple opening portions 53 is exhausted outside the machine through the inside of the exhaust duct G2 by the exhaust fan F2, which is the second blowing portion. In other words, the exhaust duct G2 is configured so that the air exhausted from the supplying feeding passage R1 passes through it.

It is also configured so that air V2 is blown from the inside of the blowing duct G1 to the discharge feeding passage R2 through a plurality of opening portions 55. Therefore, water vapor emitted from the sheet S that has passed through the nip N4 of the feeding roller pair 42 is also exhausted outside the machine through the discharge feeding passage R2. Thus, condensation downstream of the fixing unit 3 in the sheet feeding direction CD can be reduced, and image defects caused by condensation can be reduced.

As described above, the present embodiment is configured so that air is blown from the plural opening portions 52 and exhausted from the connecting portion 54 and the plural opening portions 53 for the space SP where condensation is particularly likely to occur. This improves the ventilation efficiency of the space SP, stabilizes the humidity in the supplying feeding passage R1, and reduces condensation. Also, since the post-fixing roller pair 41 and the feeding roller pair 42 are composed of a pair of rollers uniformly long in the widthwise direction W, the degree of cooling of the sheet S is less likely to be uneven, and uneven gloss can be reduced. In this way, both image defects caused by condensation and uneven gloss caused by uneven cooling can be reduced, and high-quality results can be provided.

In case only air blowers are installed to blow air into the space SP, or only air exhausters are installed to exhaust air from the space SP, it is necessary to increase the size of the blowing fans and exhaust fans in order to achieve sufficient ventilation efficiency. On the other hand, in the present embodiment, air can be blown from the plural opening portions 52 and exhausted from the connecting portion 54 and the plural opening portions 53 from the space SP, so the blowing fans and exhaust fans can be downsized.

Second Embodiment

Next, the second embodiment of the present invention will be described. The second embodiment consists of the first embodiment without the post-fixing roller pair 41. For this reason, the same structures as the first embodiment are omitted from the figures or are described with the same codes in the figures.

[Air Flow in the Fixing Unit and Discharge Reversal Portion]

Figure 6:
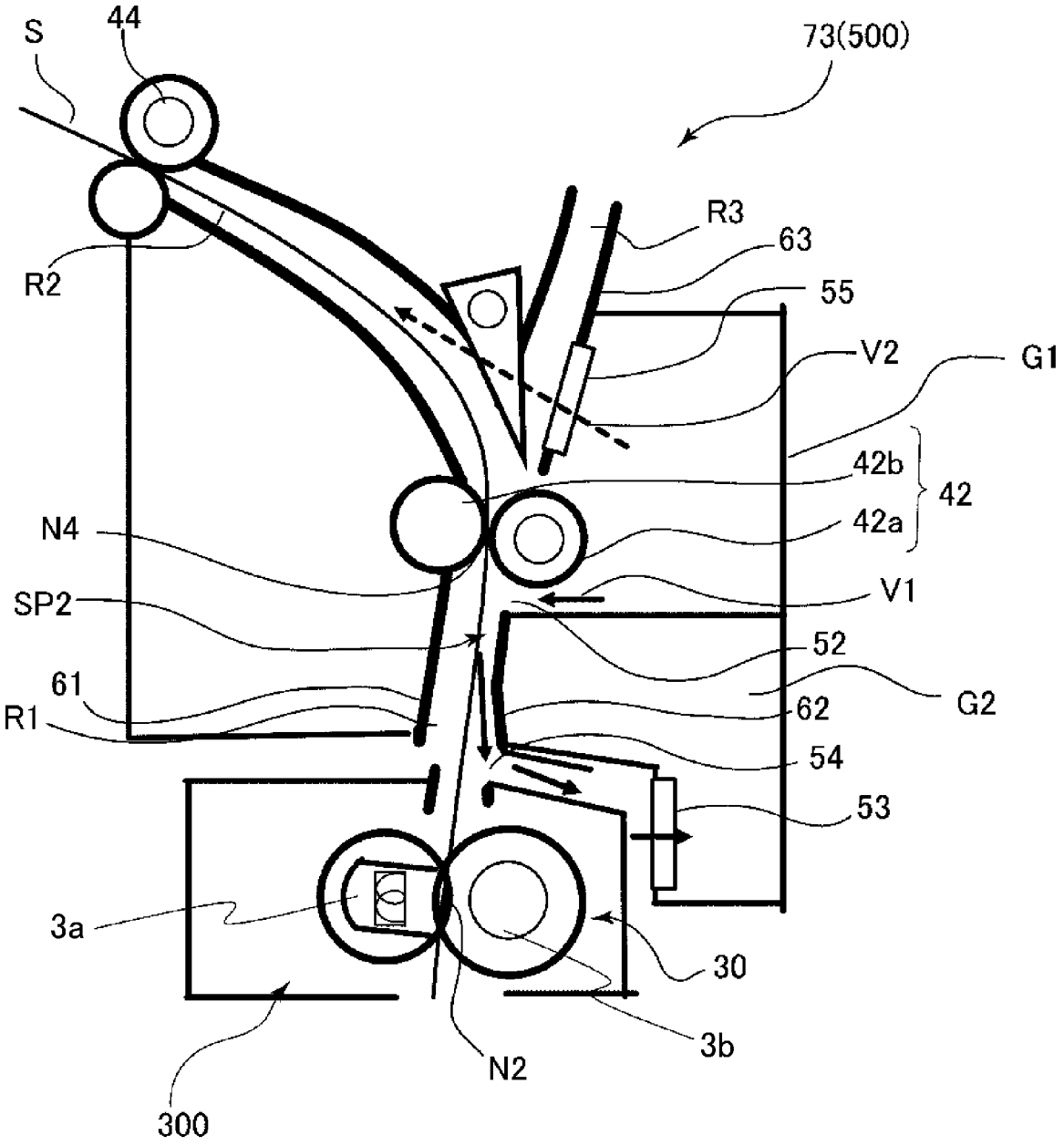
FIG. 6 is a cross-sectional view showing air flow in the fixing unit and discharge reversal portion for the second embodiment.

FIG. 6 illustrates the air flow through the fixing unit 300 and discharge reversal portion 73. When the sheet S is nipped by the fixing nip N2 of the fixing roller pair 30 and the nip N4 of the feeding roller pair 42, space SP2 is formed in the widthwise direction W (see FIG. 4) by the fixing roller pair 30, the feeding roller pair 42, the second guide 62 and the sheet S. In the present embodiment, the fixing roller pair 30 and the feeding roller pair 42 extend uniformly in the widthwise direction W and are arranged to contact the sheet S over the entire width of the sheet S. This is to prevent uneven cooling of the sheet S, resulting in uneven gloss.

The space SP2 faces the non-image surface SB of the sheet S (see part (d) of FIG. 2), and as explained in parts (a) through (d) of FIG. 2, more moisture is released from the non-image surface SB of the sheet S than from the image surface SA. Therefore, for example, condensation tends to occur on the second guide 62 that surrounds the space SP2. However, the condensation can be suppressed by sufficiently ventilating the space SP2.

Hence, in the present embodiment, the blowing duct G1 and the exhaust duct G2 are installed in connection with the space SP2. Specifically, the blowing duct G1 is connected to the supplying feeding passage R1 by a plurality of opening portions 52, and the exhaust duct G2 is connected to the supplying feeding passage R1 by a connecting portion 54 and a plurality of opening portions 53.

The blowing duct G1 is configured so that air V1 is blown from the inside of the duct to the supplying feeding passage R1 (space SP2) through a plurality of opening portions 52 by a blowing fan (not shown). Specifically, the blowing fan is positioned at the front side of the blowing duct G1 in the widthwise direction W (the front side of the widthwise direction W in FIG. 4), and air V1 is blown from the front side of the blowing duct G1 in the widthwise direction W to the back side. Since the back side of the blowing duct G1 in the widthwise direction W is blocked, the air V1 blown into the blowing duct G1 is blown from the plural opening portions 52 to the supplying feeding passage R1. Air V1 flows through the supplying feeding passage R1 (space SP2) from the upstream side of the sheet feeding direction CD to the downstream side, and the air inside the space SP2 is forced through the connecting portion 54 to the multiple opening portion 53. The air that has passed through the multiple opening portions 53 is exhausted outside the machine through the inside of the exhaust duct G2 by the exhaust fan (not shown). The exhaust fan is positioned at the back side of the exhaust duct G2 in the widthwise direction W (the front side of the widthwise direction W in FIG. 4), and exhausts the air inside the exhaust duct G2 from the front side to the back side of the widthwise direction W.

It is also configured so that air V2 is blown from the inside of the blowing duct G1 to the discharge feeding passage R2 through a plurality of opening portions 55. Therefore, water vapor emitted from the sheet S that has passed through the nip N4 of the feeding roller pair 42 is also exhausted outside the machine through the discharge feeding passage R2. Thus, condensation downstream of the fixing unit 3 in the sheet feeding direction CD can be reduced, and image defects caused by condensation can be reduced. As described above, the same effect as the first embodiment can be achieved.

Other Embodiments

In any of the above-mentioned embodiments, the fixing roller pair 30 is composed of a fixing roller 3*a* with a built-in heater 26 and a pressure roller 3*b*, but this is not limited to this. For example, instead of the fixing roller 3*a* and the heater 26, a cylindrical fixing film and a heater that is positioned inside the fixing film and heats the fixing nip N2 may be adopted. The heater is not limited to a direct contact with the fixing film but may also contact the fixing film through a sheet material with high thermal conductivity such as iron alloy or aluminum.

In the first embodiment, the blowing duct G1 and exhaust duct G2 connected to the feeding passage between the post-fixing roller pair 41 and the feeding roller pair 42 were described. Furthermore, in the second embodiment, the blowing duct G1 and exhaust duct G2 connected to the feeding passage between the fixing roller pair 30 and the feeding roller pair 42 are described, but they are not limited to these. In other words, it is sufficient to install the above-mentioned blowing duct G1 and exhaust duct G2 to the feeding passage between two adjacent roller pairs in the sheet feeding direction CD, through which the sheet passes after fixing the toner image.

The number, shape and arrangement of the multiple opening portions configured in the blowing duct G1 and exhaust duct G2 are not limited. For example, there may be one or more opening portions configured in the blowing duct G1 to blow air (wind) into the supplying feeding passage R1. However, in order to form high quality images on sheets of various sizes, it is preferable to be able to blow air over the entire width of the sheet passing area AR.

In all the above-mentioned embodiments, the air flowing through the supplying feeding passage R1 by the blowing duct G1 and the exhaust duct G2 flows from the downstream side to the upstream side in the sheet feeding direction CD, but this is not limited to this. For example, the blowing duct G1 can be installed upstream of the exhaust duct G2 in the sheet feeding direction CD, and the air in the supplying feeding passage R1 can be configured to flow from the upstream side to the downstream side in the sheet feeding direction CD.

In all the previously mentioned embodiments, the blowing duct G1 and exhaust duct G2 were connected to the space facing the non-image surface SB of the sheet S, but this is not limited to this. For example, the blowing duct G1 and exhaust duct G2 may be connected to the space facing the image surface SA of the sheet S.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-159775 filed on Sep. 24, 2020, which is hereby incorporated by reference herein in its entirety.

What is claimed is:

1. A fixing device comprising:

a fixing portion configured to heat a toner image formed on a first side of a sheet and to fix the toner image on the sheet;

a first rotatable member pair provided on a downstream side of said fixing device with respect to a sheet feeding direction and configured to feed the sheet;

a second rotatable member pair provided adjacent to the downstream of said first rotatable member pair with respect to the sheet feeding direction and configured to feed the sheet;

a guide portion configured to contact with a second side of the sheet opposite to the first side of the sheet fed by said first rotatable member pair and guide toward said second rotatable member pair, said guide portion forming a part of a feeding passage between said first rotatable member pair and said second rotatable member pair with respect to the sheet feeding direction;

a blowing portion configured to blow air toward said feeding passage;

a first duct configured to guide the air from said blowing portion and communicate with said feeding passage at a first position on the downstream side of said first rotatable member pair and on an upstream side of said second rotatable member pair with respect to the sheet feeding direction; and a second duct configured to guide the air from said blowing portion and communicate with said feeding passage at a second position on the upstream side of the first position and on the downstream side of said first rotatable member pair with respect to the sheet feeding direction;

wherein said first rotatable member pair and said second rotatable member pair are contactable to the sheet over an entire width of the sheet passing through said feeding passage with respect to a widthwise direction of the sheet perpendicular to the sheet feeding direction; and wherein the air from said blowing portion passes through said first duct, is sent to said feeding passage from the first position, is sent to the second side of the sheet passing through the feeding passage, and then, the air from said blowing portion passes through said second duct from said feeding passage via the second position and is exhausted.

2. A fixing device according to claim 1, wherein as viewed in the widthwise direction of the sheet, said first duct and said second duct communicates with a space surrounded by said first rotatable member pair, said second rotatable member pair, said guide portion and the sheet nipped by said first rotatable member pair and said second rotatable member pair.

3. A fixing device according to claim 1, wherein said fixing portion includes a heater for heating the sheet, and wherein said guide portion, said first duct and said second duct are disposed on a side opposite to said heater with respect to a straight line passing through a first nip formed by said first rotatable member pair and a second nip formed by said rotatable member pair.

4. A fixing device according to claim 1, wherein said first duct includes a first opening portion communicating with said feeding passage and disposed on one side of a central line of said feeding passage with respect to the widthwise direction of the sheet, and a second opening portion communicating with said feeding passage at the first position and disposed on the other side of the central line, and said second duct includes a third opening portion communicating with said feeding passage and disposed on one side of the central line with respect to the widthwise direction, and a fourth opening portion communicating with said feeding passage at the second position and disposed on the other side of the central line.

5. A fixing device according to claim 1, wherein said first duct includes a plurality of openings communicating with said feeding passage and disposed over the entire width of a sheet passing area where the sheet passes through said feeding passage with respect to the widthwise direction, and wherein said second duct includes a plurality of openings communicating with said feeding passage and disposed over the entire width of the sheet passing area with respect to the widthwise direction.

6. A fixing device according to claim 1, further comprising an exhaust portion configured to exhaust the air of said feeding passage, wherein said blowing portion and said exhaust portion are provided on different positions each other with respect to a central line of said feeding passage in the widthwise direction of the sheet.

7. An image forming apparatus comprising:

an image forming portion configured to form a toner image on a sheet; and a fixing device according to claim 1.

8. A fixing device comprising:

a fixing portion provided with a fixing rotatable member pair configured to heat a toner image formed on a first side of a sheet and to fix the toner image on the sheet;

a feeding rotatable member pair provided adjacent to a downstream of said fixing rotatable member pair with respect to a sheet feeding direction and configured to feed the sheet;

a guide portion configured to contact with a second side of the sheet opposite to the first side of the sheet fed by said fixing rotatable member pair and guide toward said feeding rotatable member pair, said guide portion forming a part of a feeding passage between said fixing rotatable member pair and said feeding rotatable member pair with respect to the sheet feeding direction;

a blowing portion configured to blow air toward said feeding passage;

a first duct configured to guide the air from said blowing portion and communicate with said feeding passage at a first position on the downstream side of said fixing rotatable member pair and on an upstream side of said feeding rotatable member pair with respect to the sheet feeding direction; and a second duct configured to guide the air from said blowing portion and communicate with said feeding passage at a second position on the upstream side of the first position and on the downstream side of said fixing rotatable member pair with respect to the sheet feeding direction;

wherein said fixing rotatable member pair and said feeding rotatable member pair are contactable to the sheet over an entire width of the sheet passing through said feeding passage with respect to a widthwise direction of the sheet perpendicular to the sheet feeding direction; and wherein the air from said blowing portion passes through said first duct, is sent to said feeding passage from the first position, is sent to the second side of the sheet passing through the feeding passage, and then, the air from said blowing portion passes through said second duct from said feeding passage via the second position and is exhausted.

9. A fixing device according to claim 8, wherein as viewed in the widthwise direction of the sheet, said first duct and said second duct communicates with a space surrounded by said fixing rotatable member pair, said feeding rotatable member pair, said guide portion and the sheet nipped by said fixing rotatable member pair and said feeding rotatable member pair.

* * * * *